US006325683B1

(12) United States Patent
Yocom

(10) Patent No.: US 6,325,683 B1
(45) **Date of Patent: *Dec. 4, 2001**

(54) TROLLING SYSTEM FOR WATER CRAFTS

(75) Inventor: Garey V. Yocom, Franklin, TN (US)

(73) Assignee: Yocum-Keene Concepts, Inc., Franklin, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/852,703

(22) Filed: May 7, 1997

Related U.S. Application Data

(63) Continuation of application No. 08/486,295, filed on Jun. 7, 1995, now abandoned, which is a continuation-in-part of application No. 08/371,539, filed on Jan. 11, 1995, now abandoned, which is a continuation of application No. 07/842,315, filed on Feb. 28, 1992, now Pat. No. 5,401,195.

(51) Int. Cl.[7] ..... B60L 11/02
(52) U.S. Cl. ..... 440/6; 114/151
(58) Field of Search ..... 114/61, 151; 440/6, 440/7, 38, 46, 47; 60/221

(56) References Cited

U.S. PATENT DOCUMENTS 37,710 2/1863 Smith ..... 114/151
601,679 4/1898 Ritchie ..... 114/151

(List continued on next page.)

FOREIGN PATENT DOCUMENTS

3300380 * 7/1984 (DE) ..... 114/151
1259872 * 12/1961 (FR) ..... 440/38
0110697 * 8/1980 (JP) ..... 114/61
167294 * 10/1983 (JP) ..... 440/6
0119494 6/1986 (JP) ..... 114/151

OTHER PUBLICATIONS

Motor Guide, Advertising brochure.
Bassmaster Magazine, pp. 38 and 39, Jan., 1991.
Bassmaster Magazine, pp. 70, 73, 74 and 77–79, Jan., 1991.
Bassmaster Magazine, p. 45, May/Jun., 1984.
Bassmaster Magazine, pp. 113–116, publication date: unknown.
Bassmaster Magazine, unnumbered advertisement, May/Jun., 1984.

*Primary Examiner*—Ed Swinehart
(74) *Attorney, Agent, or Firm*—Banner & Witcoff, Ltd.

(57) ABSTRACT

A pontoon water craft having a hull with trolling mechanisms contained within the hull. The trolling mechanisms are contained in angled recesses provided in the pontoons. Control of the trolling mechanisms can be accomplished by using a control device which can actuate any one of the trolling mechanisms individually or any combination of trolling mechanisms which create a thrust or thrusts resulting in the desired movement of the water craft. The pontoons of the structure hull can help to insulate the trolling mechanisms such that noise is reduced.

20 Claims, 18 Drawing Sheets

U.S. PATENT DOCUMENTS

| | | | | |
|---|---|---|---|---|
| 1,197,181 | | 9/1916 | Buck | 440/40 |
| 1,239,009 | | 9/1917 | Hicks | 440/40 |
| 1,914,038 | | 6/1933 | Ouss et al. | 440/40 |
| 1,943,152 | | 1/1934 | Weiss | 440/40 |
| 2,145,493 | | 1/1939 | Norquist | 114/151 |
| 2,330,674 | | 9/1943 | Briggs | 114/151 |
| 2,356,301 | | 8/1944 | Brace | 440/40 |
| 3,078,680 | * | 2/1963 | Wepsala | 114/151 |
| 3,182,623 | | 5/1965 | Lehmann | 114/337 |
| 3,412,705 | | 11/1968 | Nesson | 114/150 |
| 3,464,357 | * | 9/1969 | Duport et al. | 114/151 |
| 3,492,965 | | 2/1970 | Wayfield | 114/150 |
| 3,593,050 | * | 7/1971 | Ware | 440/6 |
| 3,675,611 | | 7/1972 | Glass | 440/40 |
| 3,791,331 | * | 2/1974 | Dilley | 440/6 |
| 3,865,067 | | 2/1975 | Archer | 114/150 |
| 4,265,192 | | 5/1981 | Dunn | 114/151 |
| 4,311,108 | | 1/1982 | Horton | 114/61 |
| 4,423,696 | * | 1/1984 | Aker | 114/151 |
| 4,614,900 | * | 9/1986 | Young | 440/6 |
| 4,629,432 | * | 12/1986 | Dyrkorn et al. | 114/151 |
| 5,140,926 | * | 8/1992 | Denston | 440/6 |
| 5,181,868 | | 1/1993 | Gabriel | 440/38 |
| 5,401,195 | | 3/1995 | Yocom | 440/6 |
| 5,403,216 | * | 4/1995 | Salmi et al. | 440/6 |

* cited by examiner

TROLLING SYSTEM FOR WATER CRAFTS

CROSS REFERENCE TO RELATED APPLICATION

This application is a continuation of application Ser. No. 08/486,295 filed Jun. 7, 1995, now abandoned, which is a continuation-in-part of application Ser. No. 08/371,539, filed Jan. 11, 1995, now abandoned, which is a continuation of application Ser. No 07/842,315, filed Feb. 28, 1992, now U.S. Pat. No. 5,401,195.

BACKGROUND OF THE INVENTION

The present invention relates to trolling systems for water crafts and more particularly to trolling systems capable of maintaining the position of the water craft without anchoring.

Trolling motors have been in use since at least the 1940's. The basic structure of such motors has not changed significantly since that time. Conventional trolling motors represent an improvement over the method of propelling a water craft quietly using paddles or oars. The conventional trolling motor is quieter than paddles or oars and does not require as much work. The typical trolling motor consists of a control head which controls speed and direction. A shaft connects the control head to a motor which is connected to a propeller. The conventional trolling motor is attached to the boat. It is usually attached at the bow by a bracket. This bracket normally allows the trolling motor to be pivoted into the water when in use and out of the water when the outboard motor is used to propel the boat at high speeds.

Attachment of the trolling motor and bracket is usually made at the bow. Typically, this procedure involves drilling a series of holes into the hull of the boat and screwing the bracket onto the boat.

While the conventional trolling motor represented an improvement over paddles and oars, the conventional trolling motor has many disadvantages. First, the trolling motor is attached to the boat by drilling holes within the hull. These holes can become a source of leaks if not patched properly when the trolling motor is removed. Further, each manufacturer of trolling motors has its own special bracket design which requires different hole patterns to be drilled in the hull of the boat when trolling motors are to be changed.

Another disadvantage of conventional trolling motors is that they have to be raised or lowered when the outboard or inboard motor is to be used in propelling the water craft. In tournament fishing, the trolling motor will be raised at least 100 times a day. Thus, the fisherman likely spends approximately an hour and a half each day of fishing raising and lowering the trolling motor. This is time that should be spent fishing. Some tournaments allow the use of a helper, but for the novice or beginner, such helpers are a luxury item which they cannot afford.

Another disadvantage is that raising and lowering the trolling motor puts a constant stress on the bracket which holds the motor to the water craft. This stress causes the bracket to fail long before other components of the trolling motor fail. It is understood that many people discard their trolling motors after bracket failure even though the main components of the trolling motor are still usable. Additionally, the conventional trolling motors require equipment such as bushings for allowing 360° rotation of the trolling motor and height adjusting thumb screws for adjusting the height of the trolling motor.

In order to be effective, the conventional trolling motor should be submerged below the water line. Thus, the conventional trolling motor is subject to interference from grasses, trees, stumps, floating debris, rocks or other obstacles. Such obstacles can prevent a boat using the conventional trolling motor from having access to known fishing places or "fishing holes". Materials such as grasses or other loose debris can have the effect of jamming or clogging the propellers of the trolling motor. Some underwater obstacles cannot only jam or clog the propeller, they can also cause damage to the shaft or propeller by either bending or breaking them.

Since they extend below the water line, conventional trolling motors can present further problems. Fish can wrap the fishing line around the shaft and, thus, generate force sufficient to cause the fishing line to break. Consequently, tales of the fish that got away are perpetuated. Further, the conventional trolling motors produce a noise which can frighten the fish which may be in the immediate vicinity of the boat.

Since they are normally mounted on the front of the water craft, trolling motors operate as a distraction and obstruction to the person driving the boat. When it is desired to operate the trolling motor, the driver must stop all engines and move from the driver's seat to the position of the trolling motor to operate it. Thus, this changing of seats wastes time. Furthermore, only one person can operate the trolling motor at any time. Therefore, if two people are fishing from the same boat, one person must stop fishing and operate the trolling motor such that they can reposition the boat when desired.

Foot controls are provided for some trolling motors. However, such foot controls add to the expense of the trolling motor by adding more equipment that can break. The foot control pad must be permanently mounted in a position close to the trolling motor. Thus, the operator is immobilized when using the foot control pad. Further, an abrupt reverse of direction, if required, is almost impossible with foot control pads.

Finally, the conventional trolling motors are ineffective in cross currents, cross winds and under certain wave conditions. In order to regain control of the boat, the operator must completely circle the boat. Thus, it is apparent from the above discussion that there are many disadvantages to the conventional trolling motor.

SUMMARY OF THE INVENTION

The purpose of the present invention is to provide a low cost, permanently installed, relatively simple, trouble free trolling system which avoids many, if not all, of the above enumerated problems of the conventional trolling motor. The preferred trolling system was designed for use in a water craft having either an inboard or outboard motor. The preferred trolling motors are easily serviceable. Thus, the preferred trolling system is designed for trouble free, infield service, while allowing for easy operation. The raising and lowering of the trolling motor is eliminated by the present invention. Also, the present invention avoids hitting submerged obstacles and floating debris. Fishing lines and anchoring ropes cannot be fouled by a shaft or propellers.

In one aspect of the present invention, the preferred trolling system is configured for installation on a pontoon water craft which is one type of boat which has generally been difficult to control with conventional trolling motors. Pontoon boats typically have a hull structure defining a fore portion, a stern portion, a port side and a starboard side, and comprising a pair of pontoons in generally parallel relation to one another. The pontoons define a longitudinal passageway between them. The trolling system comprises a plurality of self-contained trolling mechanisms disposed in the hull of the water craft within recesses formed in the pontoons and angled relative to the longitudinal passageway. A control means enables a user to individually actuate each of the trolling mechanisms such that each of the trolling mechanisms produces a thrust when actuated to move the water craft in a direction opposite to the direction of the thrust. The control means allows for actuation of any one or a combination of the trolling mechanisms so that the water craft is moved by the resultant thrust. The trolling system of the present invention provides maneuverability which is greatly improved from that provided by conventional trolling motors used on pontoon boats.

In another aspect of the present invention, the self-contained trolling mechanism installed in the hull of the water craft provides flexibility and economy to both retrofit and custom build markets for trolling systems. Each self-contained trolling mechanism comprises a housing which contains a motor assembly. The motor assembly includes a trolling motor mounted in the housing near an intake end of the trolling mechanism, a bladed thrust producing device coupled to and driven by the motor, and a flow straightener mounted in the housing near an outtake end of the trolling mechanism. The motor, bladed device and flow straightener are axially aligned within the housing.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE PREFERRED EMBODIMENTS

Figure 1:
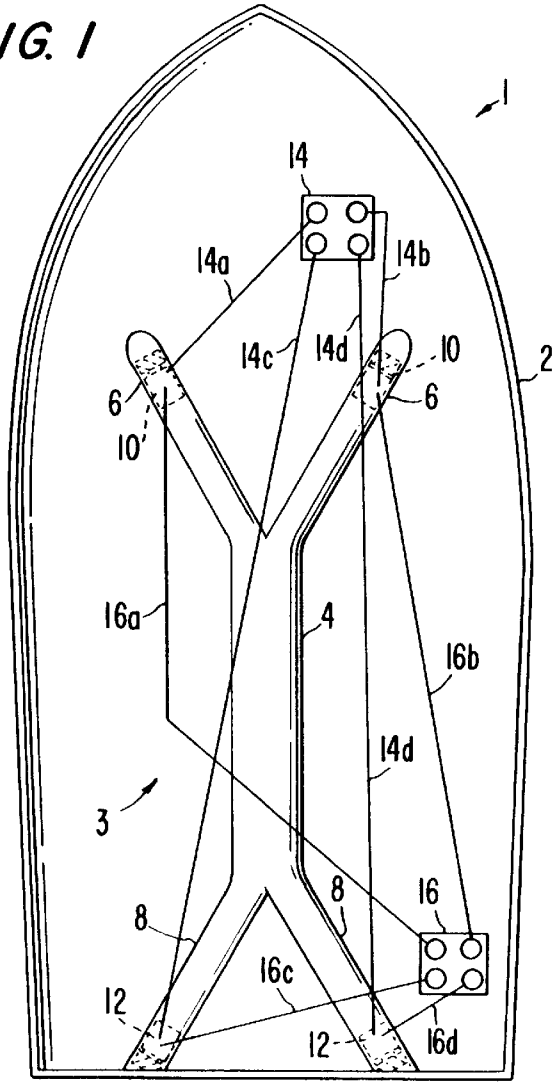
FIG. 1 is a top plan view of a water craft showing a first preferred embodiment of the present invention with the decking removed from the water craft, with the trollers shown in phantom.

Referring to the drawings wherein like numerals indicate like elements, FIG. 1 is a top plan view of one embodiment of the present invention. Boat 2 and trolling system 3 are collectively indicated by the reference numeral 1. Boat 2 has contained therein a tubular channel or fluid passageway 4 that extends along a longitudinal axis of the boat. Passageway 4 diverges into two separate angled passageways 6 adjacent the bow or fore portion of boat 2. Passageway 4 also diverges into two separate angled passageways or channels 8 adjacent the stem or rear portion of the boat 2. Passageways 6 and 8 are angled from the longitudinal axis at preferably about 27½°. This angle can be varied by about 5 to 10°. The size of the water craft the weight of the water craft or the shape of the water craft are some of the factors that are used to determine the angle of these passageways. The purpose of angled passageways 6 and 8 will be explained further below.

One directional impeller motors 10 and 12 are contained within angled passageways 6 and 8, respectively. A control pad 14 having four switches is operatively connected to impellers 10 and 12 by lines 14*a*, 14*b*, 14*c* and 14*d*. Impeller motors 10 and 12 rotate in only one direction. Thus, four switches are preferred for completely controlling water craft movement.

Actuation of the switch attached to line 14*a* causes the port side front impeller motor to be actuated. Actuation of the switch attached to line 14*b* causes the starboard side forward impeller motor to be actuated. Actuation of the switch attached to line 14*c* causes the port side rear impeller motor to be actuated. Actuation of the switch attached to line 14*d* causes the starboard side rear impeller motor to be actuated. Thus, each impeller is independently operable.

A second control pad 16 is provided in the rear of boat 2. Control pad 16 also has four switches and lines 16*a*, 16*b*, 16*c* and 16*d*. The actuation of the switches of control pad 16 is similar to the actuation of the switches of control pad 14 and, thus, the same reference letters are used to indicate which lines actuate each impeller motor. Although it is not necessary that the motors be one directional, in this invention they can be one directional to lower cost.

Control pads 14 or 16 do not have to be physically attached to the impeller motors. One or both of the control pads can be a radio controlled device. Other remote control systems can also be used for enabling the operator to move from one position in the boat to another while still having control over the impeller motors and hence the trolling operation of boat 2. Also if certain remote control units are used, the trolling motion of the water craft can be controlled from shore or some other location than the water craft.

Control pads 14 and 16 do not have to consist of a plurality of switches, but can be a joystick, a steering wheel, foot pedals or may just consist of switches or buttons having icons indicating water craft movement.

Figure 2:
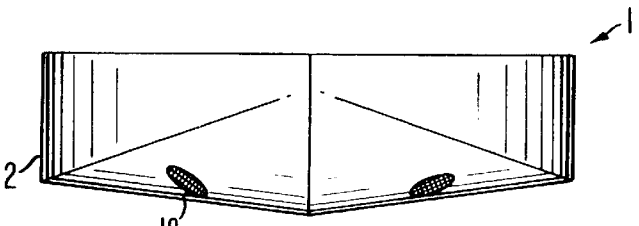
FIG. 2 is a front view of FIG. 1.
Figure 3:
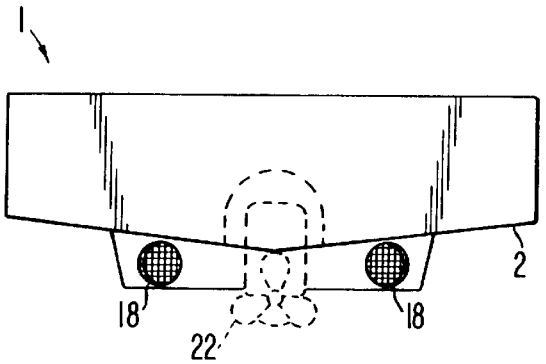
FIG. 3 is a rear view of FIG. 1 showing the water craft incorporating an inboard motor.

FIGS. 2 and 3 show front and rear views of the boat of FIG. 1. Both FIGS. 2 and 3 show that it is preferable to have screens 18 in place for blocking materials such as grass or other submerged debris from entering passageways 6 and 8. Thus, fouling of the impellers 10 and 12 can be prevented. FIG. 3 shows boat 2 having an inboard motor 22 which is the main propulsion unit for boat 2. Inboard motor 22 and outboard motor 24 are two types of primary motors envisioned as being usable with the present invention. However, the invention is not limited to use with water craft having these types of motors. Although not necessary, it is preferred to have the motors and impellers at the ends of the angled passageways. This should also reduce the intrusion of debris into the passageways.

In addition, it is preferred that passageways have openings of approximately 3' in diameter.

Figure 4:
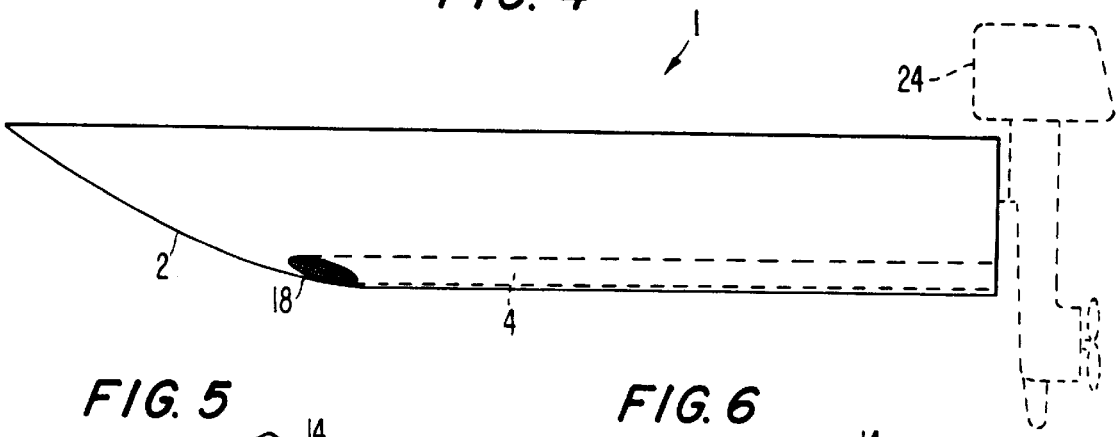
FIG. 4 is a side view of the embodiment of FIG. 1 showing the water craft incorporating an outboard motor.

FIG. 4 is a side view of the boat of FIG. 1. However, instead of inboard motor 22, outboard motor 24 is attached to the taffrail of the boat. Inboard motor 22 and outboard motor 24 are both generally capable of moving boat 2 at high speeds. Such motors can be rated at from around 25 horsepower to more than 200 horsepower. Some motors are capable of propelling the boat at speeds in excess of 70 mph. In order for boat 2 to be able to be propelled at these speeds, passageways 6 and 8 are preferably angled such that these passageways do not impair high speed movement. Also, angled passageways will allow for quieter approaches to fishing areas when trolling. Further, impeller motors 10 and 12 are insulated by the hull and this also helps to reduce noise which might frighten fish. In other words, the boat can move in a trolling manner without producing noise sufficient to frighten nearby aquatic creatures.

Impeller motors 10 and 12 are generally rated in the range of a fraction of a horsepower to approximately 5 horsepower. However, the size of the trolling motors is a function of the weight and shape of the water craft, just as the size of the inboard or outboard motor required is dependent upon such parameters.

Debris can be prevented from entering angled passageways 6 and 8 by screens 18. However, if material or debris should block screen 18, all that is required is a momentary activation of the one directional impellers should force the debris clear of screen 18.

Figure 5:
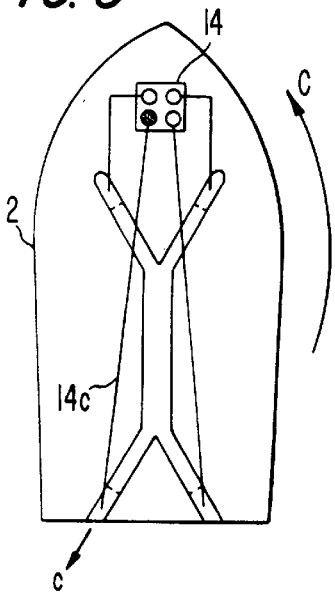
FIGS. 5–14 show schematically control and movement of the water craft using a control pad.
Figure 6:
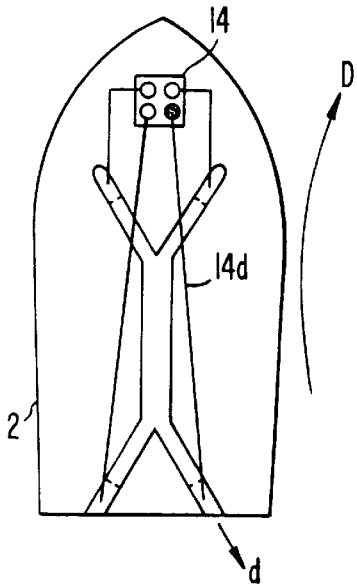
Figure 7:
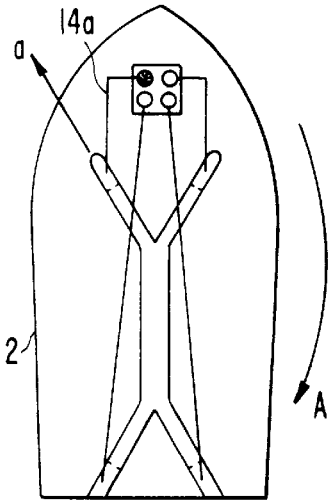
Figure 8:
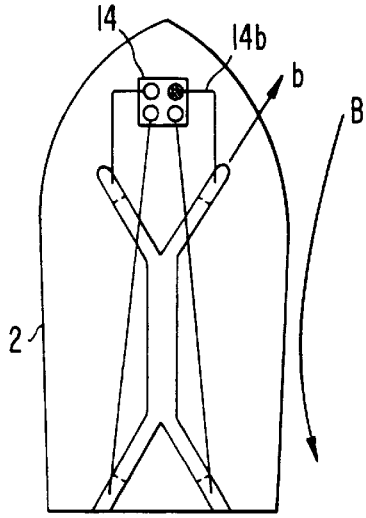

FIGS. 5–14 show the thrust from a particular impeller or combination and the corresponding movement of boat 2. When the left rear impeller is actuated, a thrust c is caused to move the boat in a wide turn C toward the left as shown in FIG. 5. When the right rear impeller motor is actuated, a thrust d is caused and the boat turns to the right in a large circle D, as shown in FIG. 6. Actuation of the port side front impeller causes a thrust a and turn A turns the boat to the rear and left as in FIG. 7. As shown in FIG. 8, actuation of the right front impeller motor alone causes a thrust b and a turn B toward the rear and right.

Figure 9:
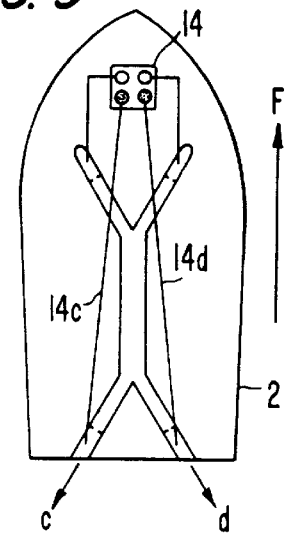
Figure 10:
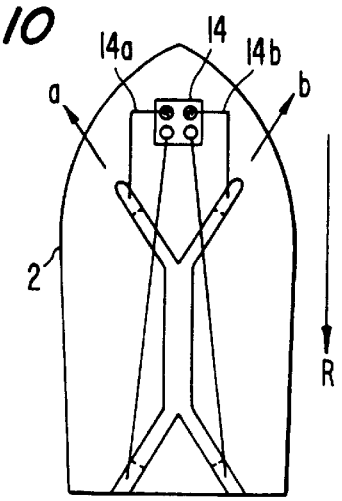
Figure 11:
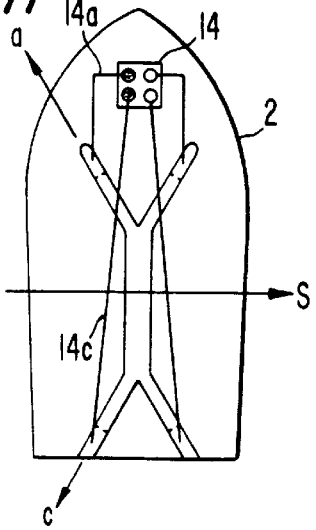
Figure 12:
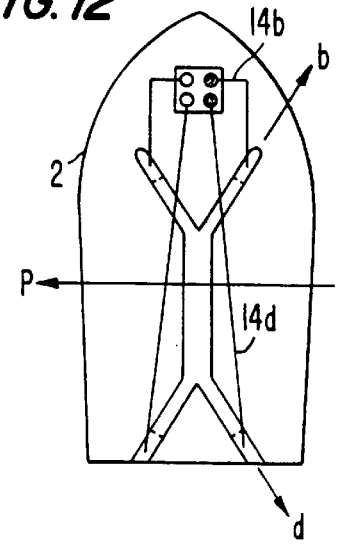
Figure 13:
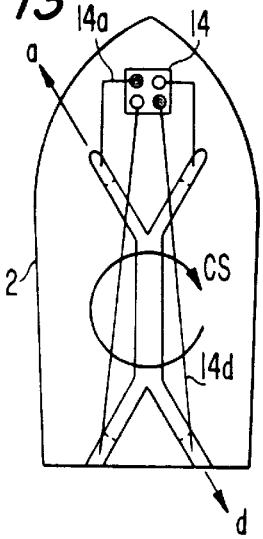
Figure 14:
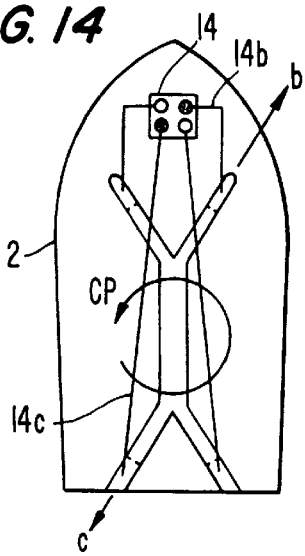

When both rear impellers are actuated, thrusts c and d are provided. The sideward components of the thrusting forces cancel out and a forward movement F, shown in FIG. 9, is caused. Actuation of the forward impeller motors causes thrusts a and b to be produced and a rearward movement R of boat 2, as shown in FIG. 10. If the port side impeller motors are actuated, thrusts a and c produces a movement to the right or starboard S as shown in FIG. 11. When the starboard side impellers are actuated, as in FIG. 12, thrusts b and d cause a movement to the left P or port side. Actuation of the forward port side impeller motor and the rearward starboard side impeller motor cause thrusts a and d and produces a tight circle CS that moves boat 2 in a clockwise direction as shown in FIG. 13. If the starboard side forward impeller motor and the rearward port side impeller motor are actuated, thrusts b and d cause a tight circular movement for boat 2 in a counterclockwise direction as shown in FIG. 14.

In addition, recesses are angled relative to the longitudinal axis of the hull so that the boat or water craft can be almost immediately stopped without overrunning the desired position. For example, by implementing exact opposite counter motors momentarily at the end of each position change, substantially all inertia and momentum of the water craft can be dispelled immediately. In other words, the water craft can be stopped exactly where the operator wants it without overrunning the desired position. Thus, the trolling system described herein can make most any desired water craft correction simple including the finishing touch of winding up exactly where you want to be.

Furthermore, it is recognized that variations on FIGS. 5–14 can be made to obtain different combinations of direction change. It is also recognized that the thrusts of the different impellers could be independently controlled and modified to bring about different directional changes. For example, the impellers can be controlled to hold the water craft stationary in water with a current without using an anchor. These variations can be encompassed by this invention.

Figure 15:
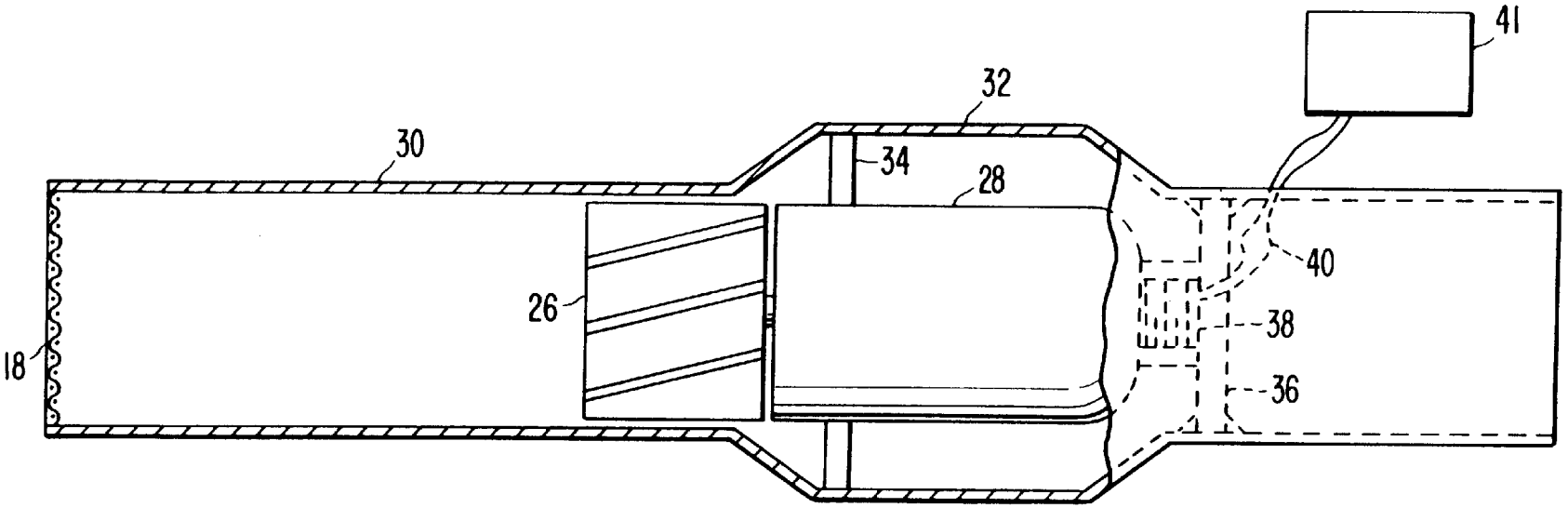
FIG. 15 shows an angled passageway with a trolling motor contained therein.

A typical impeller with motor is shown contained within a passageway in FIG. 15. The passageway has forward portion or end 30 which is covered by screen 18. End 30 includes an enlarged section 32 which houses impeller motor 28 with impeller 26 extending into forward portion 30. Support members 34 and 36 position and hold impeller motor 28 within enlarged section 32. Enlarged section 32 allows the drainage of water from the flow lines or passageways during takeoff using the main power source, i.e., the inboard or outboard motor. Drainage is improved since enlarged section 32 increases the flow rate of water in and around the impeller motors.

Impeller motor 28 is attached to support 36 by use of a screw thread coupling 38. Motor 28 is a one-directional electric motor connected to a source of power 41 such as a battery, a solar powered cell or a generator through screw coupling 38 and leads 40. While a screw thread coupling is show for attaching impeller motor 28 in enlarged portion 32, such a coupling may take the form of a quick connect type coupling, a snap fit coupling or any other coupling which allows easy removal of impeller motor 28. Also, the leads 40 do not have to pass through the coupling, but may attach separately to the impeller motor 28.

It is preferred to have removable motors 28 for at least two reasons. Should a motor cease to operate, a spare motor can quickly replace it. Also, servicing the motor can then be done without taking the water craft out of service.

Figure 16:
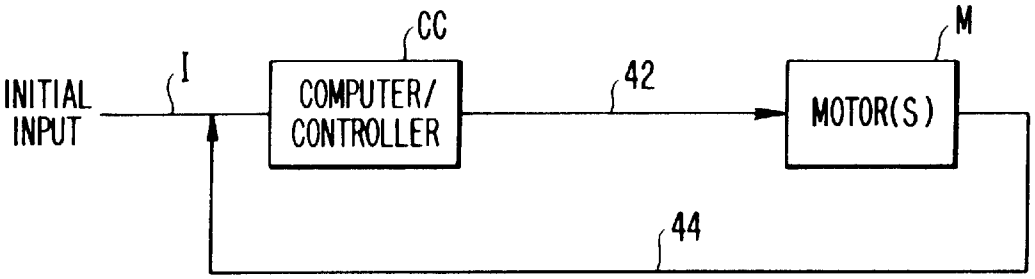
FIG. 16 shows one embodiment of a controller for the present invention.

FIG. 16 illustrates one embodiment of a computer controlled circuit for the present invention. In this circuit, an initial input I is input to the computer/controller CC. The computer/controller CC sends a signal along line 42 to motors M. Motors M are caused to actuate given the instructions sent from computer/controller CC. An output from the motors M is then fed back along line 44 to the computer/controller CC. Thus, feed back control of motors M is achieved. Initial input I can come from the control pad or from some other remote control source or be preprogrammed. A delay circuit or a delay program can be used to provide intermittent operation of the impeller motors.

Figure 17:
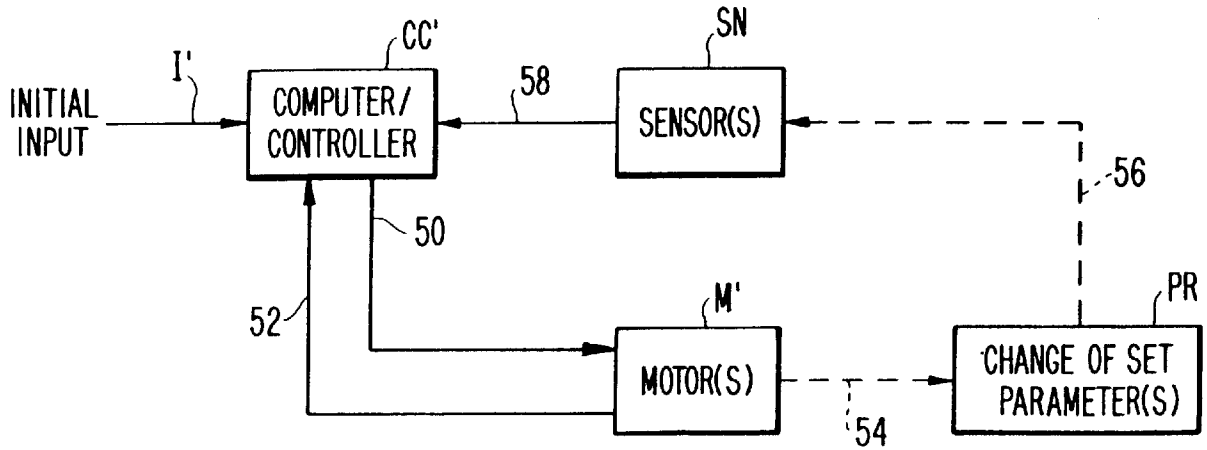
FIG. 17 shows another embodiment of a controller for the present invention.

FIG. 17 shows another type of control circuit which can be used with this system. An initial input I' is fed into computer/controller CC'. The computer/controller CC' sends a signal along line 50 to motors M'. Motors M' can then send a signal back along line 52 to the computer/controller CC'. This portion of the control circuit is similar to the control circuit of FIG. 16. However, this circuit differs in that when motors M' change a set parameter such as the position of the water craft, this information is fed back along line 56 to sensors SN. Sensors SN then feed the information along line 58 back to computer/controller CC'. Computer/controller CC' can then start the water craft, adjust the speed or change the impeller motor or impeller motors that are to be actuated. Thus, computer/controller CC' can effectively position the water craft depending upon any number of sensor readings such as depth or temperature of water, position from shore, or some other variables.

Figure 18:
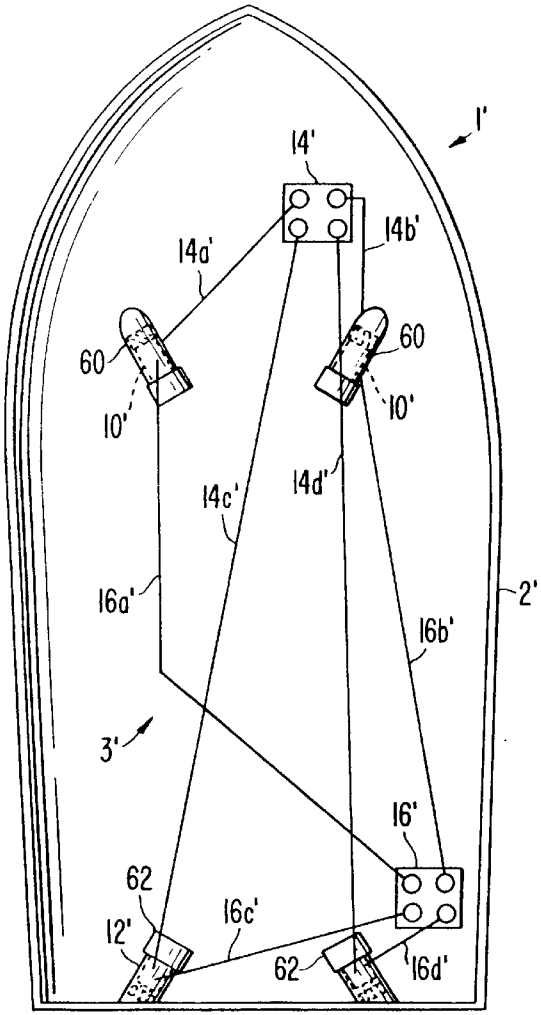
FIG. 18 shows a top plan view of a water craft having the flooring removed illustrating a second preferred embodiment of the present invention.

FIG. 18 shows a second preferred embodiment of a boat using a trolling system in accordance with the present invention. In this embodiment, like elements are given a prime reference number when they are similar to the items discussed with regard to the embodiment of FIG. 1. In this embodiment, boat 2' includes four impellers 10' and 12' positioned at the rear and forward portions of boat 2'. Control pads 14' and 16' are connected to the impeller motors. Both control pads 14' and 16' operate in the same manner as control pads 14 and 16 to thus control the impeller motors and the movement of boat 2'.

Figure 19:
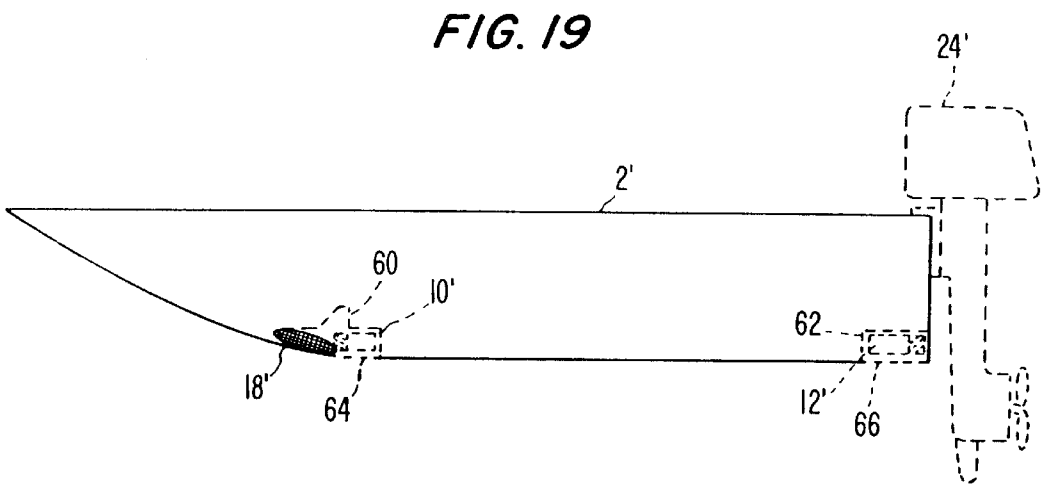
FIG. 19 shows a side view of the embodiment of FIG. 18.

Impeller motors 10' and 12' are contained within recesses 60 and 62, respectively, in the hull of boat 2'. As seen in FIG. 19, recesses 60 and 62 do not extend the full length of the boat, but merely form pockets for containing impeller motors 10' and 12'. Screens 18' cover the exit area of recesses 60 and 62. Water intakes 64 and 66 are provided for recesses 60 and 62 to, thus, allow water to flow into recesses 60 and 62 and be impelled by impeller motors 10' and 12' through screens 18'. Thus, the need for a longitudinal passage along the length of the boat is eliminated. Further, as shown in FIG. 19, boat 2' uses an outboard motor 24'.

However, it should be noted that boat 2' could use an inboard motor or some other primary power source.

Figure 20:
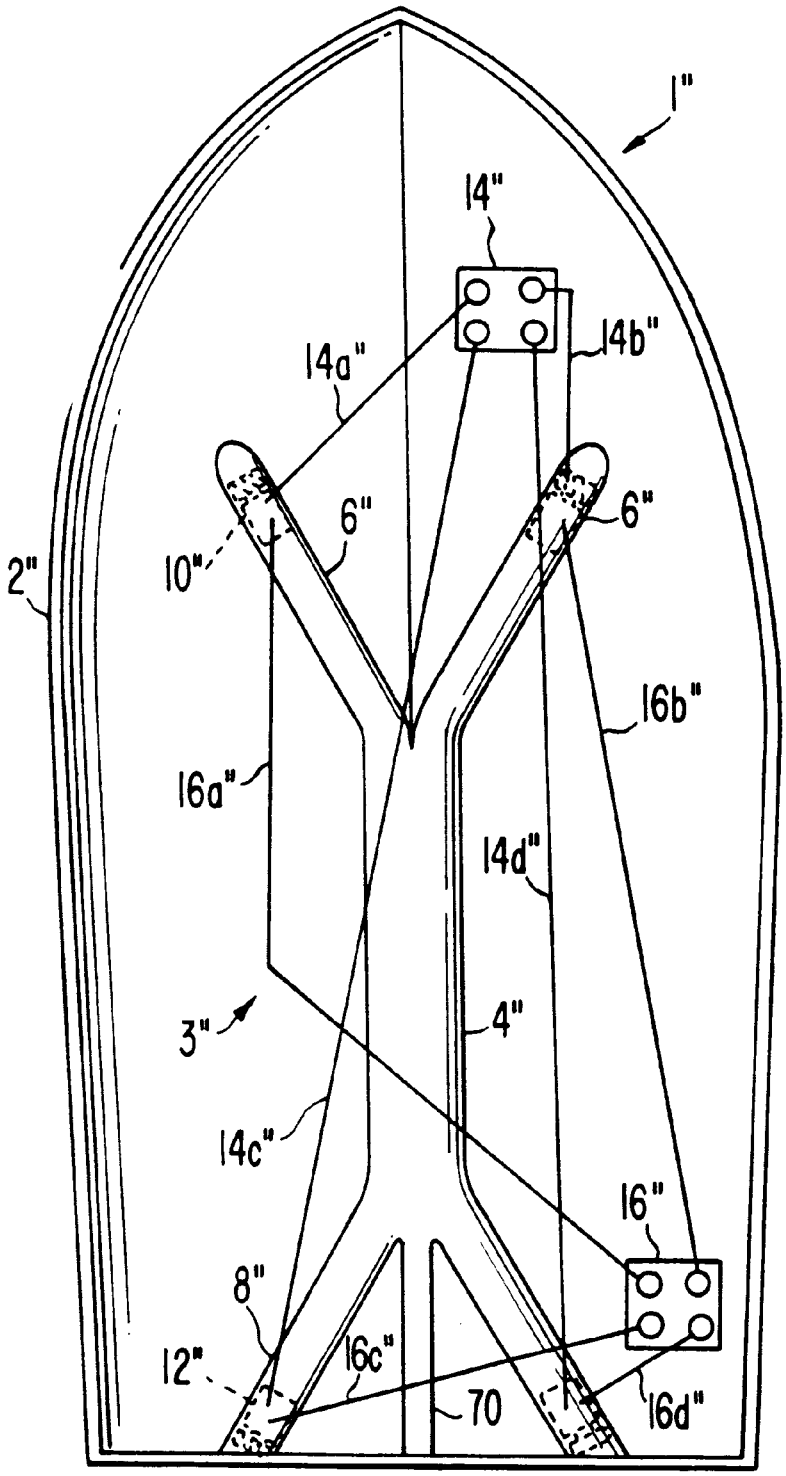
FIG. 20 is a top plan view of a third preferred embodiment of a water craft incorporating the present invention.

FIG. 20 shows a third preferred embodiment of a boat using a trolling system in accordance with the present invention. In this embodiment, like elements are denoted by double prime reference numbers when they are similar to the items discussed with regards to the embodiment of FIG. 1. Boat 2" includes fluid passageway 4" and angled passageways 6" and 8". Impeller motors 10" and 12" are contained in their respective angled passageways. Control pads 14" and 16" are operatively linked to each of impeller motors 10" and 12" in a fashion similar to the embodiment of FIG. 1.

An additional or passive intake/exhaust port 70 can be provided in boat 2 at a position immediately in front of the primary motor. Passive port 70 is in fluid communication with passageway 4", 6" and 8". Other positions for passive port 70 are possible. However, the primary motor provides some protection from large debris and also provides for quick drainage of water from passageways 4", 6" and 8" during takeoff by the primary motor. Passive port 70 also provides a constant supply of water to counter possible vacuum effects caused by having opposed impellers. Thus, floating debris which may be pulled to a screen 18 of an inactive impeller motor does not reduce the supply of water to the active impellers.

Figure 21:
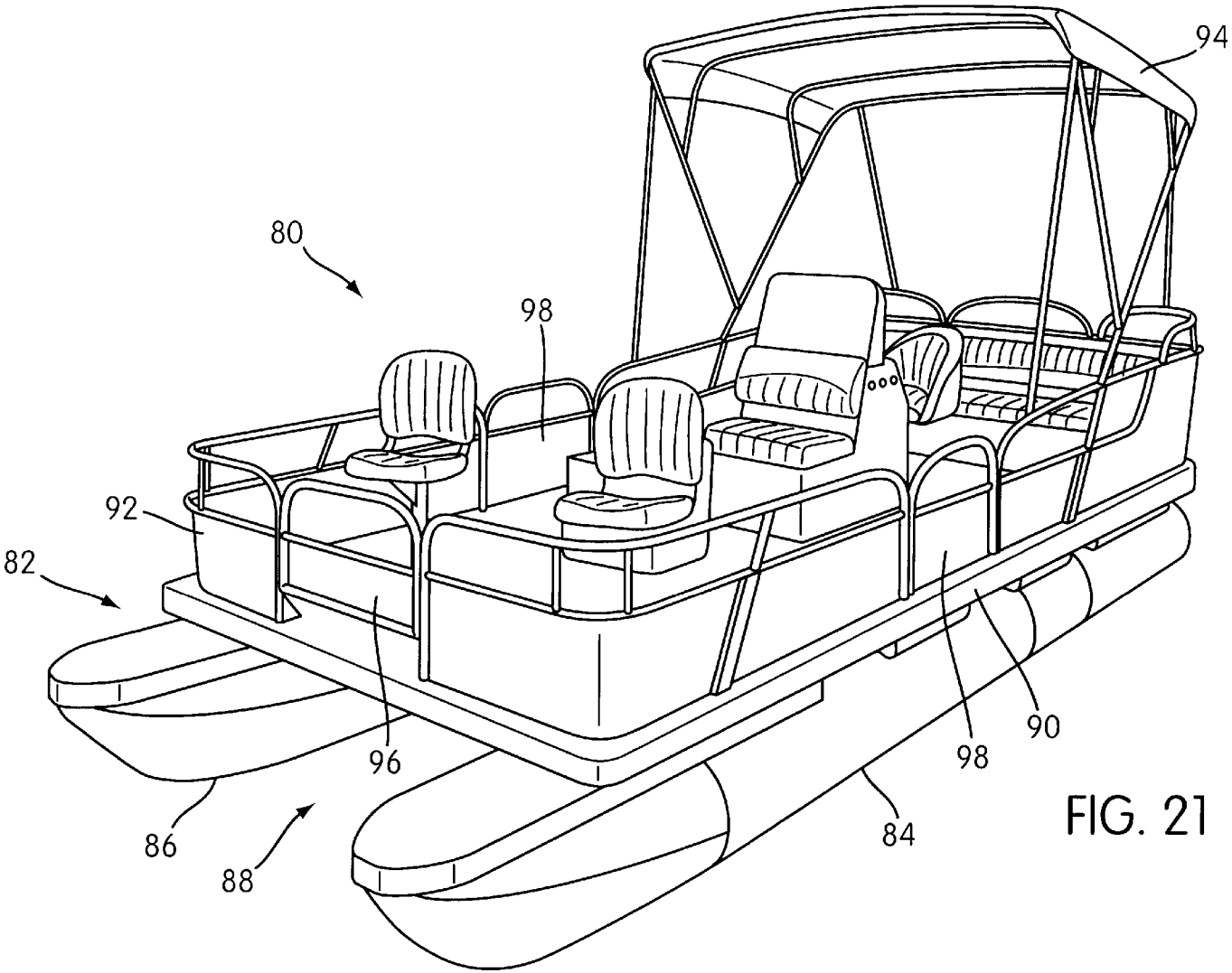
FIG. 21 is a perspective view of a pontoon watercraft.

FIG. 21 shows a pontoon boat 80 which includes a hull structure 82 comprising two parallel pontoons 84, 86 defining a longitudinal passage 88 therebetween. Pontoon boat 80 also comprises a deck 90 and guard railing 92 surrounding the deck. The lower surface of deck 90 is secured to and extends between the two pontoons 84, 86. A canopy 94 may be stretched over part of deck 90 to provide shade to the passengers. At the bow of the boat, a gate 96 is provided for passenger access to deck 90. Side gates 98 also provide access if boat 80 is docked between walkways. FIGS. 21–49 illustrate a fourth preferred embodiment of the trolling system of the present invention.

Due to the features which are peculiar to the design of a pontoon boat, conventional trolling motors presented many difficulties. For instance, since conventional trolling motors are generally mounted at the bow of the boat, using one on a pontoon boat interfered with operation of gate 96. In addition, canopy 94 easily picks up even the slightest breeze, not to mention a stiff wind, making controlling the boat extremely difficult with a conventional trolling motor. The trolling system of the present invention overcomes these difficulties by providing trolling mechanisms which are not mounted to the deck and therefore out of the way, and by providing sufficient power to overcome the sail-effect of canopy 94.

Figure 22:
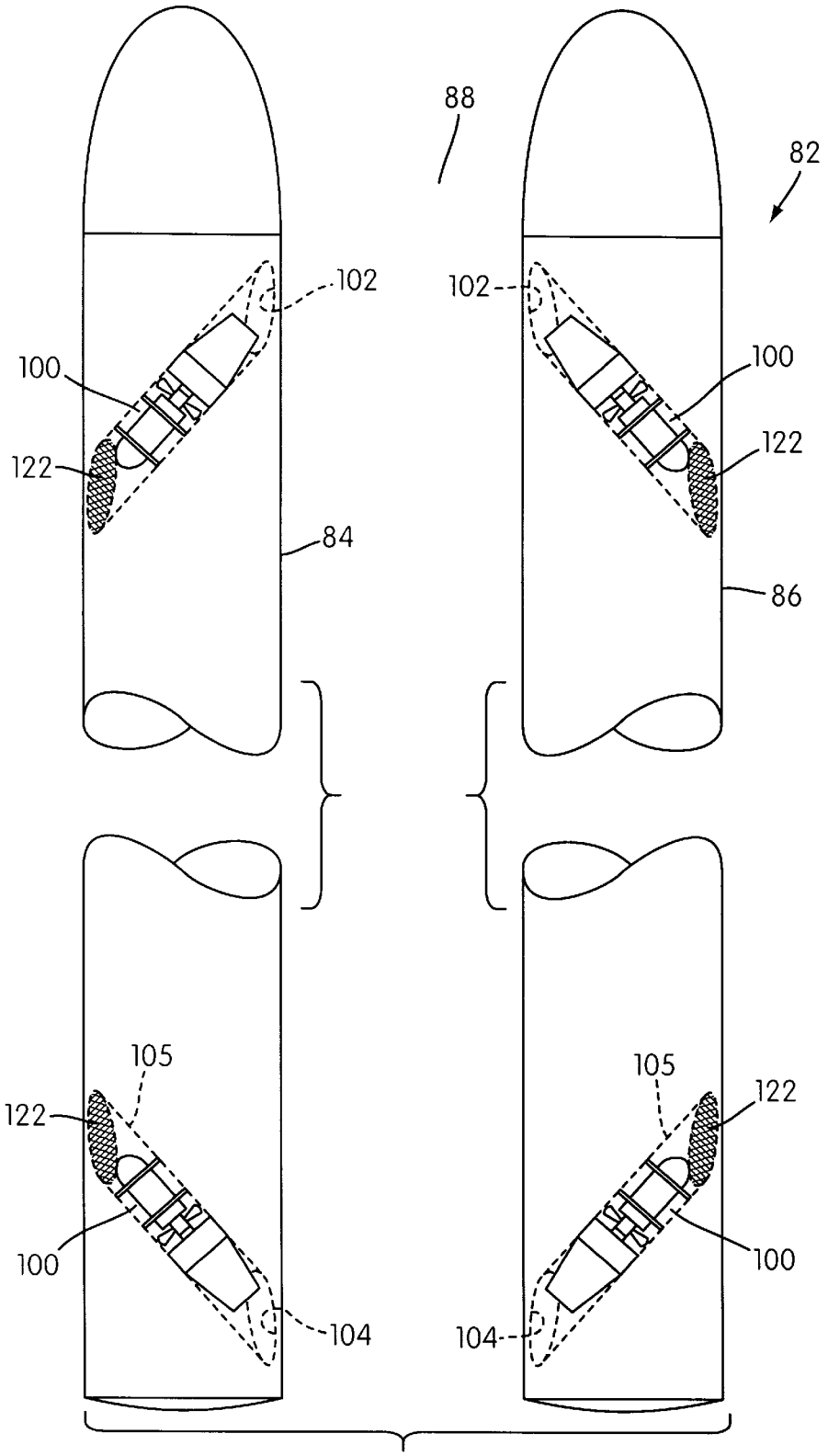
FIG. 22 is a top plan view of a fourth preferred embodiment of the present invention configured for a pontoon watercraft shown with the decking removed showing only the pontoons of the water craft hull, with the trollers in phantom.

FIG. 22 shows pontoons 84 and 86 (illustrated with a break) with the decking removed to illustrate the placement of a troller mechanism 100 in each of four locations. Similar to the previous embodiments, two troller mechanisms are positioned in the hull near the bow or fore portion of the boat, and two troller mechanisms are positioned in the hull near the stern or rear portion of the boat. Each pontoon 84 and 86 includes a troller recess 102 in the bow portion and a troller recess 104 in the stern portion each receiving a troller mechanism 100 therein. Troller recesses 102 in the bow portion are angled to diverge rearwardly, and recesses 104 in the stern portion are angled to diverge forwardly. The recesses are provided with aluminum tubes welded therein.

In this pontoon boat embodiment, the configuration of the angled troller recesses differs from the configuration of the angled passageways and recesses of the first embodiment of the present invention. The rearwardly diverging recesses 102 in the bow portion and forwardly diverging recesses 104 in the stern portion are arranged to provide optimum maneuverability. Their exact positions and arrangement depends to a large degree upon the distance between the pontoons and the length of the pontoons. For example, in a pontoon boat having a platform 8 feet across and pontoons which are 20 feet long and 22 inches in width, the pontoons would be spaced apart 6 feet center-to-center. As a general rule the forward recesses are located about ⅓of the way back from the front, in this case approximately 6⅔feet from the front of each pontoon, and the rear recesses are located as far back as possible. The angles of divergence from longitudinal range from approximately 20° to 40° for both the forward and rear recesses. The larger the angle, the more manuverability, and the smaller the angle the more thrust. Suitable adjustments would be made if any of the above-recited parameters vary.

Figure 23B:
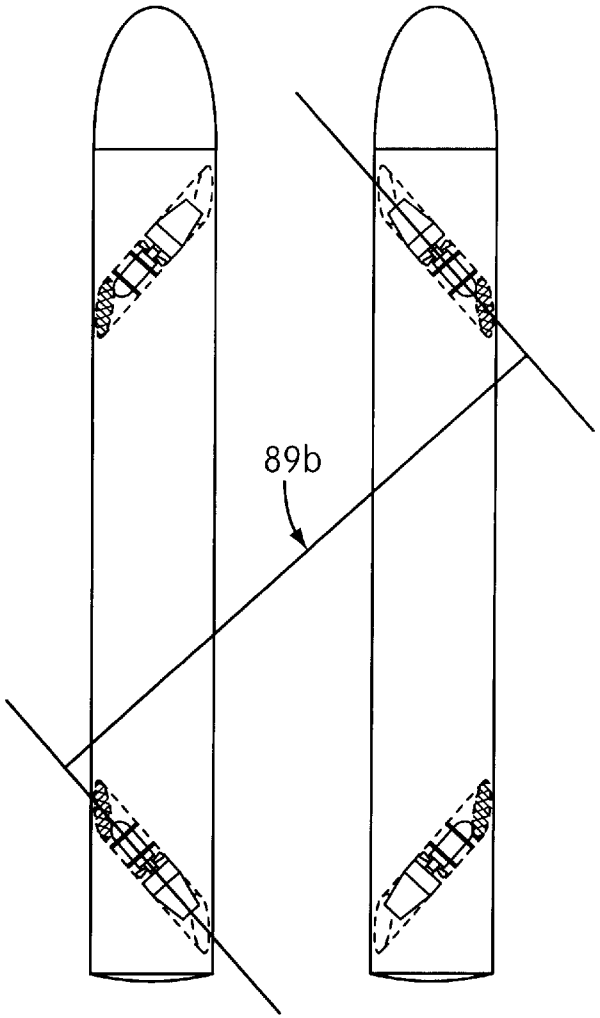
FIGS. 23A and 23B are schematic representations of pontoons with fulcrum lengths plotted.
Figure 23A:
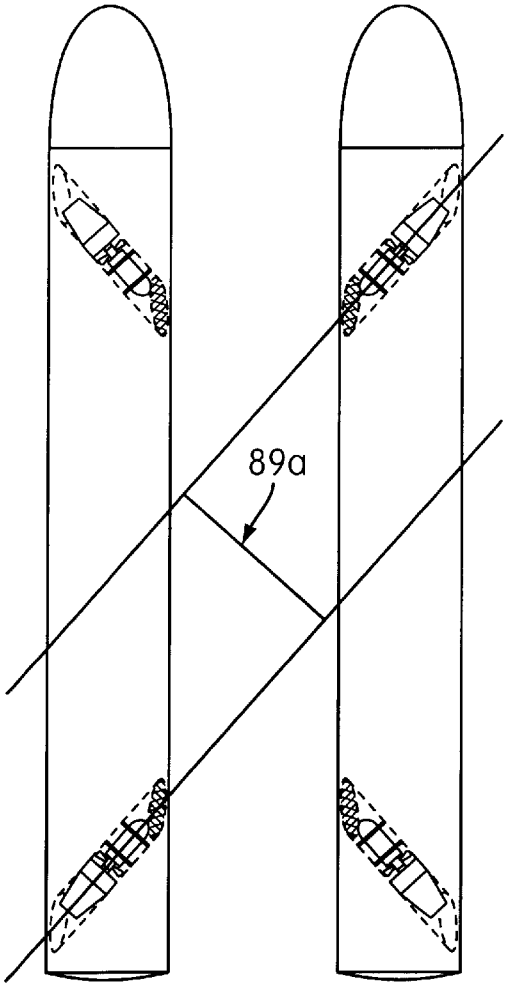
Figure 24:
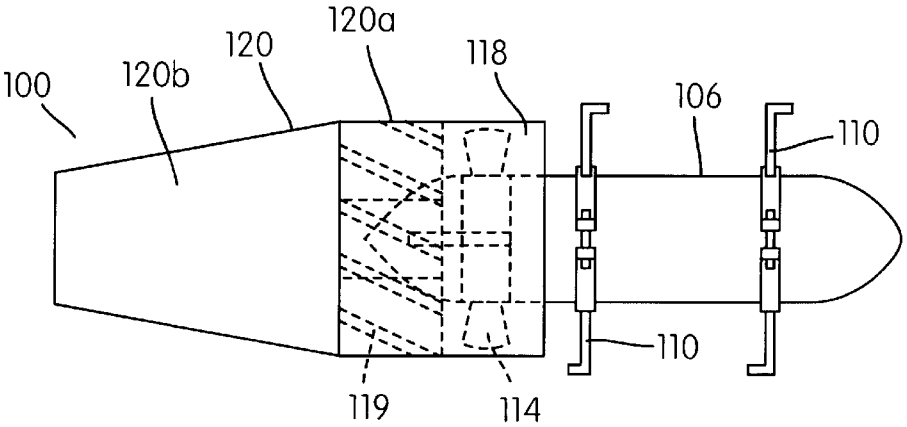
FIG. 24 is a plan view of a troller mechanism shown in FIG. 22.
Figure 26:
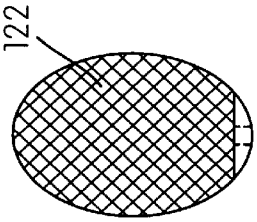
FIG. 26 is a plan view of a debris screen shown in FIG. 22.
Figure 25:
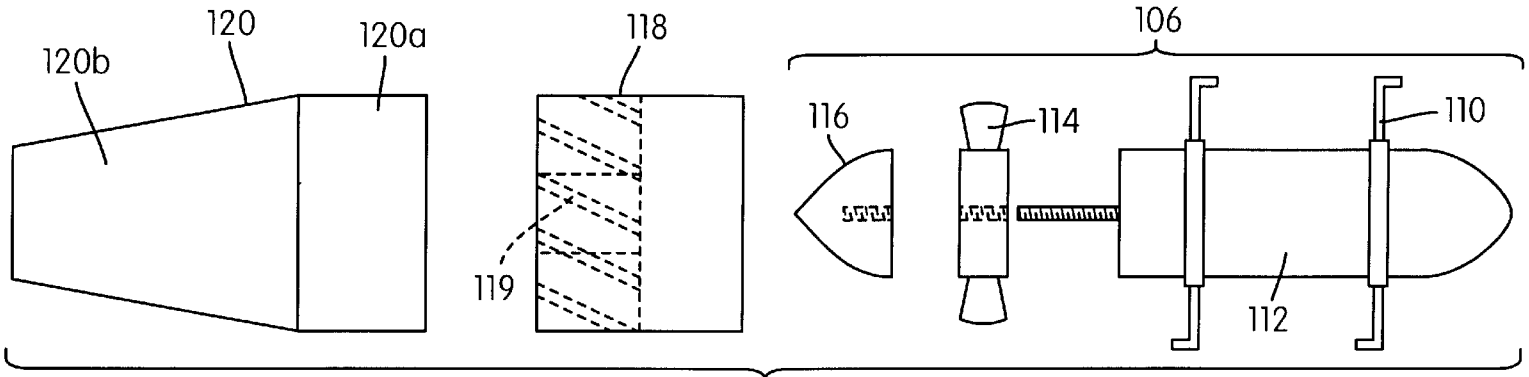
FIG. 25 is an exploded plan view of the troller mechanism shown in FIG. 24.
Figure 27:
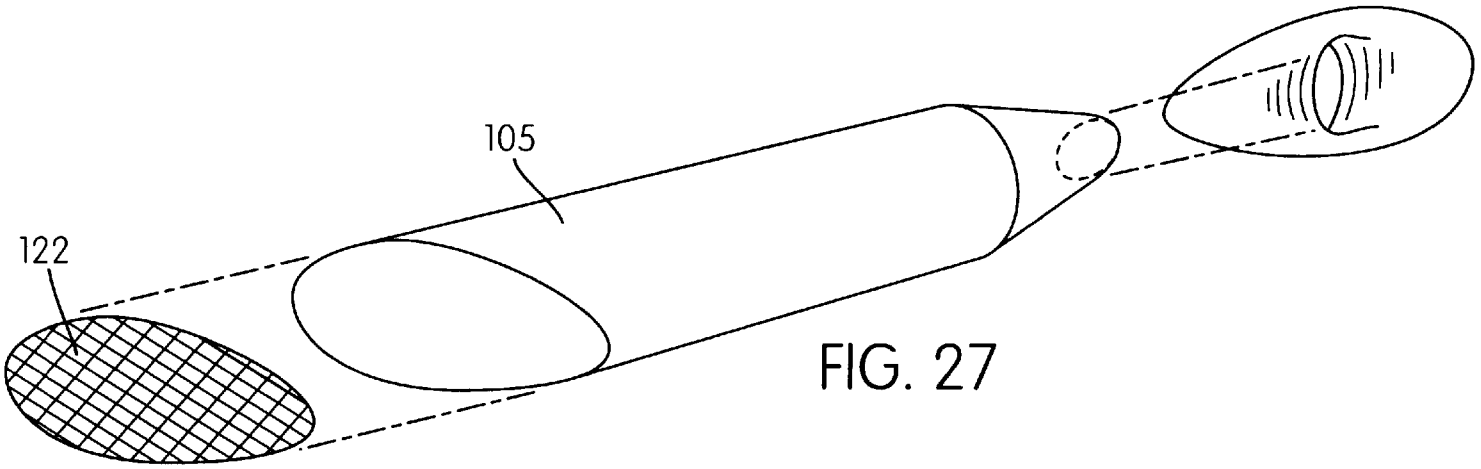
FIG. 27 is an exploded perspective view of a tube shown in phantom in FIG. 22 removed from its recess.
Figure 28:
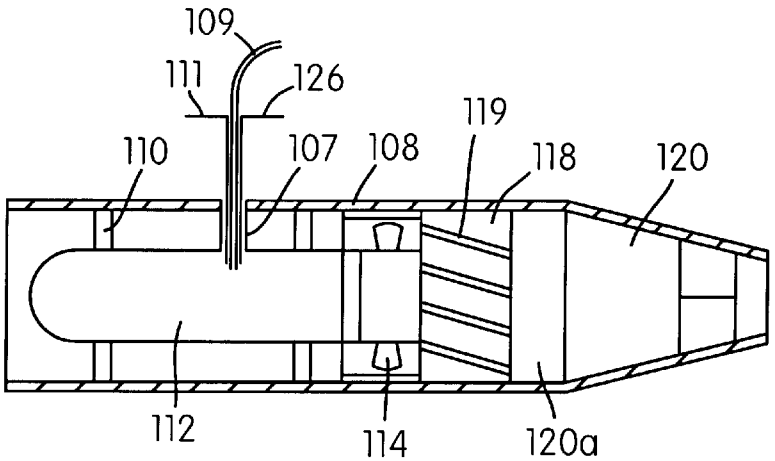
FIG. 28 is a cross-sectional view of an assembled housing and motor assembly.

A design parameter which was developed to optimize the maneuverability of the pontoon boat is called the "fulcrum"

length. Reference is made to FIGS. 23A and 23B in which two different arrangements of the recesses are shown. In order to plot the fulcrum length, lines are drawn through diagonal ones of the recesses along the lines of thrust that would be generated from within those recesses. The thrust lines of diagonally related recesses are generally parallel. The perpendicular distance between the parallel thrust lines is the "fulcrum" length. It has been determined that the greater the fulcrum length, the better the turning results in maneuvering the boat. The angles of divergence will also vary according to the lengths of the pontoons and the distance between them. Either of the configurations shown in FIGS. 23A and 23B may be used, but the arrangement of FIG. 23B is the preferred embodiment.

FIG. 23A illustrates the pontoons of a boat with fore portion recesses in the pontoons which diverge forwardly and stern portion recesses which diverge rearwardly. A fulcrum length 89*a* is plotted for this configuration. While this fulcrum length affords sufficient maneuverability, increasing its length by adjusting the longitudinal spacing between fore and aft recesses and/or adjusting the angles of divergence of the recesses will enhance maneuverability.

The fulcrum length can be maximized by arranging the recesses as seen in FIG. 23B which illustrates the pontoons of an identical boat with the opposite divergences, i.e., the fore portion recesses in the pontoons diverge rearwardly and the stern portion recesses diverge forwardly. When a fulcrum length 89*b* is plotted for this configuration, it is much greater than the distance between the pontoons, and much greater than fulcrum length 89*a* in FIG. 23A. It has been found that the configuration shown in FIG. 23B generally provides for superior maneuverability. Therefore, in designing the pontoon boat system, the objective is to maximize maneuverability by maximizing the fulcrum length.

As seen in FIGS. 24–28, each troller mechanism 100 is a self-contained driving mechanism which includes a motor assembly 106 contained in a housing 108. Each motor assembly 106 is preferably attached within housing 108 by spider clamps 110. Motor assemblies 106 each include a motor 112, power blade 114 and cone 116. A flow straightener 118 is provided to cooperate with a thrust tube/compressor chamber 120 which has a substantially cylindrical thrust tube portion 120*a* and a frusto-conical compressor chamber portion 120*b*. Flow straightener 118 is preferably cylindrical and includes straightening vanes 119 provided within. Flow straightener 118 also has an unvaned section which is configured to house blades 114. Clamp 110 which is closest to the flow straightener may be located so that the unvaned section of flow straightener 118 can be attached to the legs of the clamp. This may be accomplished by providing slits in the unvaned section which can engage the legs of clamp 110 with a friction fit. Alternatively, any conventional fastening means can be used. In the preferred embodiment, cylindrical portion 120*a* of component 120 can receive the vaned section of flow straightener 118. However, the attachments and relative sizes of component 120 and flow straightener may vary. The length of flow straightener 118, and in particular, the length of the vaned section will depend upon variables such as the power output of the motor and the angles of divergence.

As described above, each trolling mechanism is a self-contained driving mechanism, and this characteristic provides for great flexibility in use and installation. The motor assembly is a conventional trolling motor fitted with a rotatable thrust producing device, cone and flow straightener. The rotatable thrust producing device moves fluid when rotated such that a thrust force is generated. The device may be bladed, commonly referred to as an impeller or propeller, or may comprise a tube-like member with vanes for contacting and moving fluid when rotated. It will be understood that the terms "impeller" and "propeller" are used generically herein to refer to devices which move fluid when rotated. In the present preferred embodiment, a bladed impeller having four blades is used. The size of the impeller blade depends upon such factors as the size of the pontoon, and the desired output. As an example, for a 22-inch pontoon, 7-inch aluminum tubes were used in the recesses and the impeller blades span approximately 6⅝inches, producing between 20 and 30 lbs. of thrust. The sizes would be appropriately scaled for smaller or larger pontoons.

The motor assembly is sealed within housing 108, and an exhaust port 107 is provided for equalizing pressure when the motor is cooled. Without exhaust port 107, the changes in pressure within the sealed motor assembly which occur when the motor is cooling, i.e., from a higher pressure when the motor is warm to a lower pressure when the motor cools, creates a vacuum effect which would draw water into the motor and cause damage. Exhaust port 107 serves to stabilize the pressure within the sealed motor assembly.

Exhaust port 107 serves another function in the wiring of the motor assembly. The wiring, a power line 111 and a control line 126 for each motor assembly, is taken through exhaust port 107 and corresponding aperture in housing 108. A tubing 109 may be provided at exhaust port 107 to extend the exhaust. The wiring 111, 126 and tubing 109, once outside of housing 108 is run out of recess tube 105 and the recess as shown schematically in FIG. 28. Power line 111 is connected to a power source such as battery (not shown), and control line or wire 126 is connected to a switch pad 124 as seen in FIGS. 29–48. The wiring can be done exteriorly as described which simplifies any retrofit application. However, for customizing or complete retrofit applications, an internal connection system similar to that described above with respect to FIG. 15 is contemplated to be within the scope of the present invention. The connection may be made between housing 108 and recess tube 105 by contact between a device on the outside of housing 108 and a mating contact within recess tube 105 with the appropriate guide means to establish the desired contact. Of course, this type of connection would require the wiring to be complete either inside or outside the pontoon. The exhaust port could also be located on housing 108 of self-contained driving mechanism 100 so as to align with a mating port in recess tube 105 when it is inserted into the recess tube in the correct manner.

Each recess 102 or 104 has a tube 105 welded therein for reception of a self-contained driving mechanism such as trollers 100. Each tube 105 includes a debris screen 122 at the intake side of recess 102 or 104 as the case may be. Housing 108 is preferably formed by plastic, such as PVC, polyvinylchloride, and sized to be inserted into preferably aluminum tube 105 of a recess. The housing is fastened inside the tube by an interference fit or any type of known connection. This plastic-on-metal connection reduces the noise which is produced by operation of the trolling mechanism. Controlling the noise of trolling systems has always been of importance, however, with the advent of new fishing techniques which require even greater proximity to the fish, noiselessness, particularly in the area of the boat which approaches a fishing spot, is of even greater concern. The structure of the present invention has been designed with noiselessness in mind, and provides a quieter system than conventional trolling means.

As can be seen in FIG. 22, troller mechanisms 100 are positioned within their respective recesses 102 and 104 such that the intakes are to the exterior of pontoon boat 80. In other words, when troller mechanisms 100 are actuated, they will each create a thrust which is directed inward. FIGS. 29–38 illustrate the thrust direction and resultant boat movement of the troller mechanism configuration of FIG. 22 which provide an inward thrust. Alternatively, the troller mechanisms may be positioned in the recesses in the opposite configuration, that is, the intakes to the interior of the pontoon boat so that the troller mechanisms each create a thrust which is directed outward. FIGS. 39–48 illustrate the thrust direction and resultant boat movement with troller mechanisms providing an outward thrust.

Control of the troller mechanisms is achieved by actuation of switches on a switch pad 124 which is wired as shown schematically in FIGS. 29–48. Switches 124*a,* 124*b,* 124*c* and 124*d* are wired to troller mechanisms 100*a,* 100*b,* 100*c* and 100*d,* respectively, by wires 126*a,* 126*b,* 126*c* and 126*d.* Schematic FIGS. 29–48 are illustrated with a switch pad 124 and the actuated switch or switches represented by a darkened circle. A control mechanism for the operator of the boat would actuate the switches 124*a,* 124*b,* 124*c* and 124*d,* but may be configured in a variety of ways to provide an ergonomic control with direction indicators that may be more intuitive to the operator. The switch pad configuration is for purposes of explanation and the invention is not limited to any such configuration. In addition, any number of control mechanisms may be provided on the boat to enable the passengers to steer the boat from several locations. To this end, control mechanisms may be foot controlled.

In FIGS. 29–48, actuation of switch 124*a* attached to line 126*a* causes the port (or left) side front troller mechanism 100*a* to be actuated. In like manner, actuation of switch 124*b* attached to line 126*b* causes starboard (or right) side front troller mechanism 100*b* to be actuated. Actuation of switch 124*c* attached to line 126*c* causes the port side rear troller mechanism 100*c* to be actuated, and actuation of switch 124*d* attached to line 126*d* causes starboard side troller mechanism 100*d* to be actuated. Any combination of switches 124*a*–124*d* may be actuated to attain a combined or resultant boat movement. Thus, each troller mechanism is independently operable.

Figure 29:
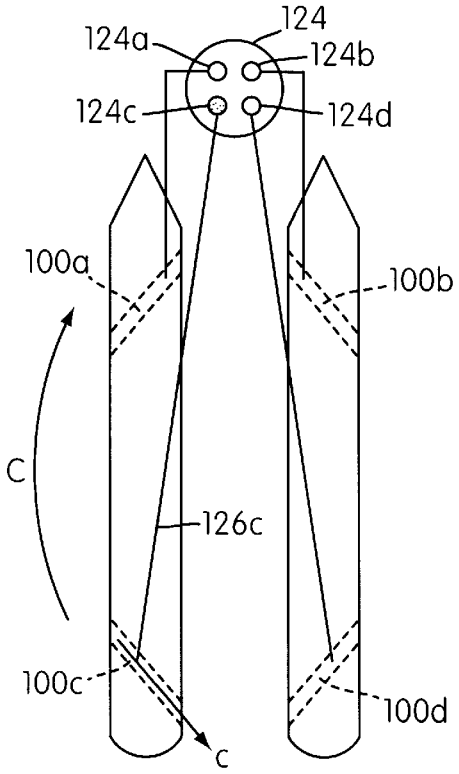
FIGS. 29–38 show schematically control and movement of the pontoon watercraft using a control pad.
Figure 30:
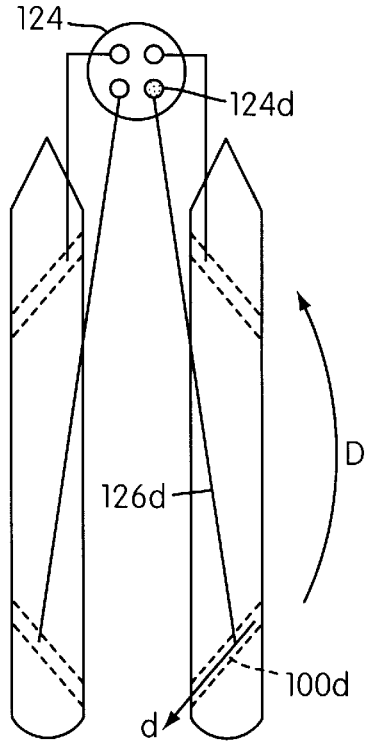
Figure 31:
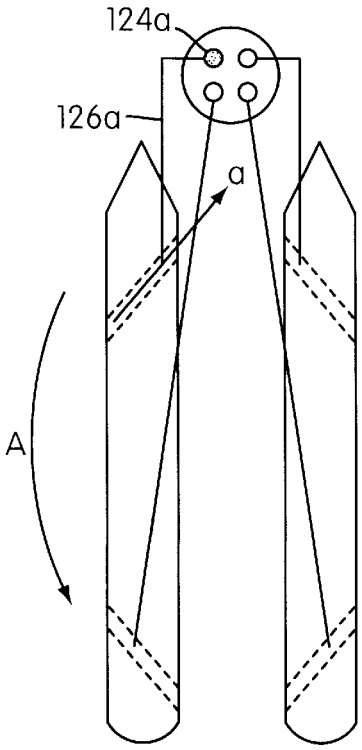
Figure 32:
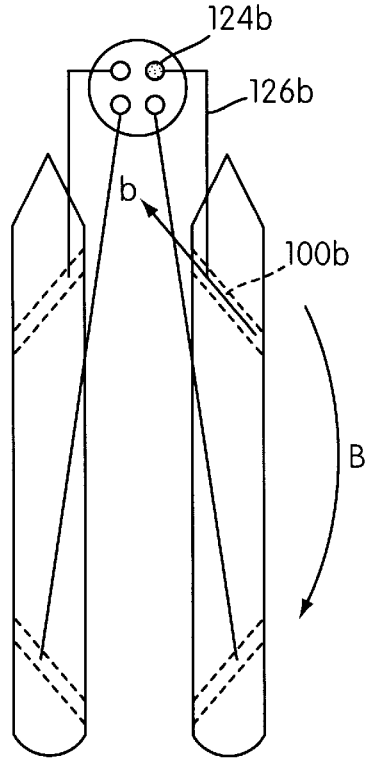

As to FIGS. 29–48, when the port side rear troller mechanism 100*c* is actuated, a thrust c is created which causes the boat to move in a wide turn C toward the right as shown in FIG. 29. When starboard side rear troller mechanism 100*d* is actuated, a thrust d is created and the boat turns to the left in a wide turn D as shown in FIG. 30. Actuation of the port side front troller mechanism 100*a* creates a thrust a resulting in a wide turn A toward the right and rear as in FIG. 31. As seen in FIG. 32, actuation of troller mechanism 100*b* on the front, starboard side creates a thrust b which causes the boat into a wide turn B toward the left and rear.

Figure 33:
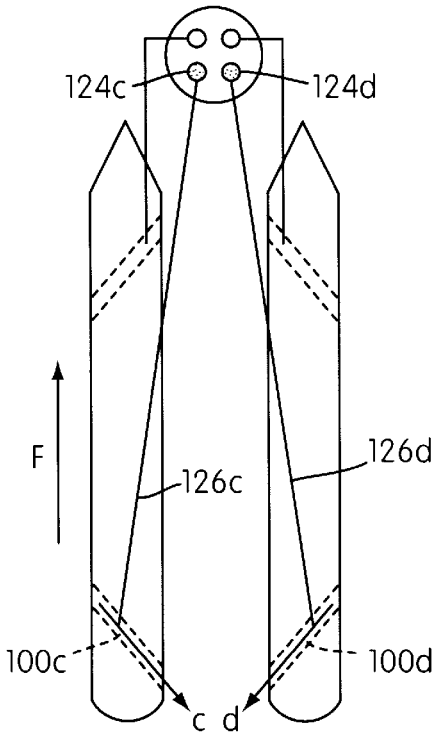
Figure 34:
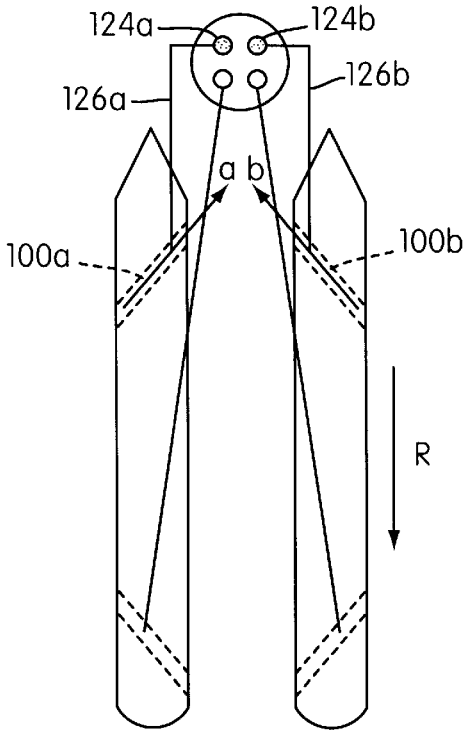
Figure 35:
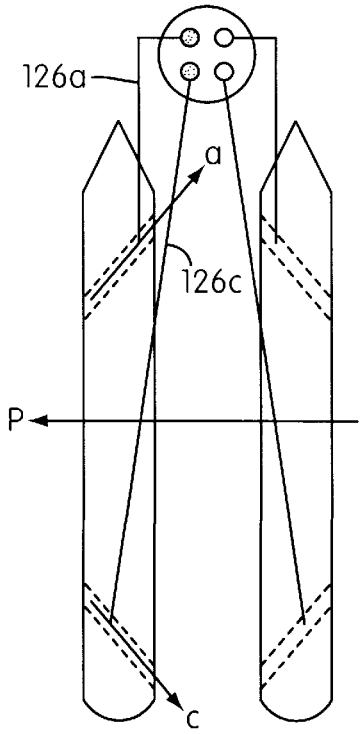
Figure 36:
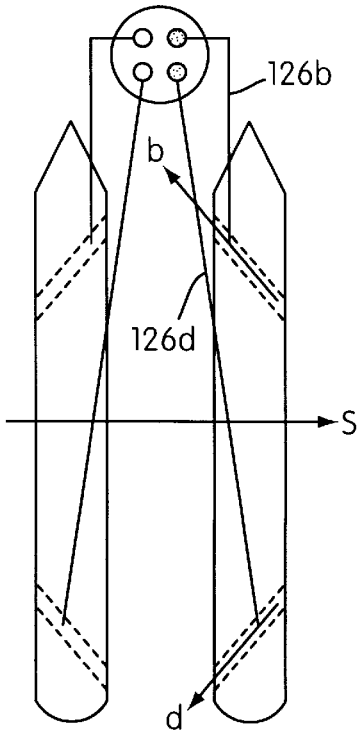

When both rear troller mechanisms 100*c* and 100*d* are actuated simultaneously, thrusts c and d combine in a resultant forward movement F shown in FIG. 33. Similarly, when both front troller mechanisms 100*a* and 100*b* are actuated simultaneously, thrusts a and b combine in a resultant rear movement R of the boat as shown in FIG. 34. If the port side troller mechanisms 100*a* and 100*c* are actuated, thrusts a and c combine in a resultant movement P to the port side as seen in FIG. 35. Actuation of starboard side troller mechanisms 100*b* and 100*d* creates thrusts b and d which combine in a resultant movement of the boat S to the starboard side as seen in FIG. 36.

Figure 37:
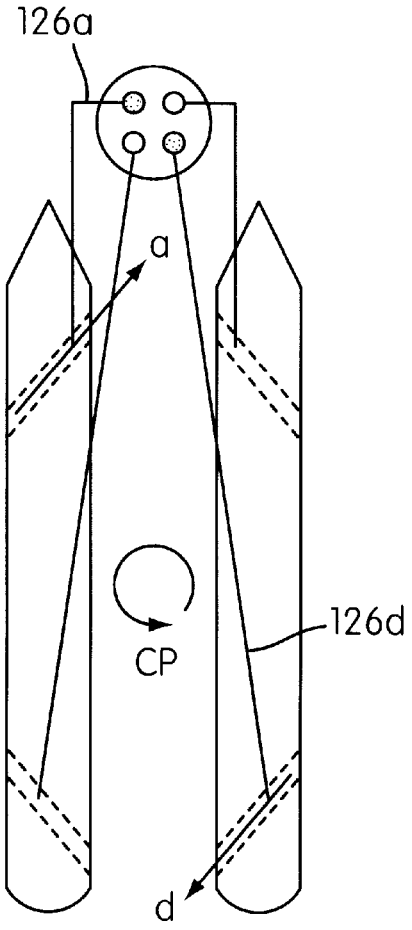
Figure 38:
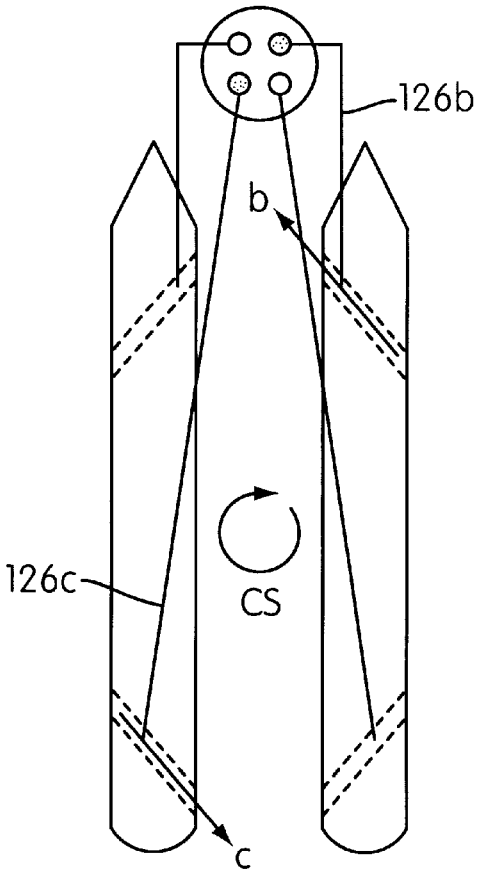

Actuation of front port side troller mechanism 100*a* and rear starboard side troller mechanism 100*d* produces thrusts a and d which cause the boat to move in a tight circle CP in a counter clockwise direction as shown in FIG. 37. If front starboard side troller mechanism 100*b* and rear port side troller mechanisms 100*c* are actuated, thrusts b and c are created which combine to move the boat in a tight circle CS in the clockwise direction as shown in FIG. 38.

It will be appreciated that the thrust directions produce a resultant movement which are different than those illustrated in FIGS. 5–14 above due to the differences in the divergence of the recesses and positioning of troller mechanisms. Moreover, the thrust directions and resultant movements will vary depending on such variables as troller mechanism placement and angles of divergence of the recesses. Therefore, for the alternative configuration illustrated in FIGS. 39–48, actuation of the troller mechanisms result in different boat directions because of the positioning of the troller mechanisms to produce an outward thrust.

Figure 39:
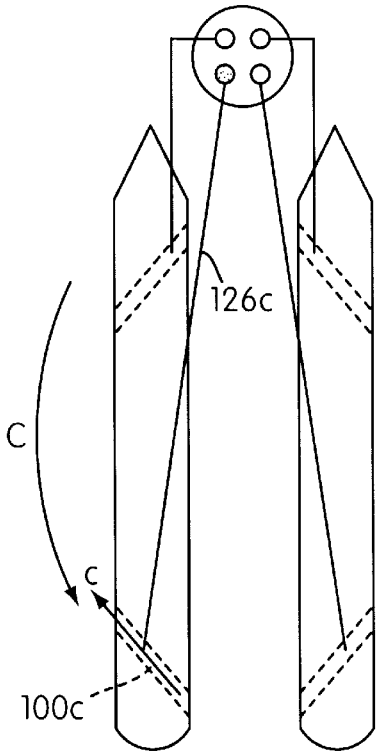
FIGS. 39–48 show schematically an alternative embodiment of control and movement of the pontoon watercraft using a control pad.
Figure 40:
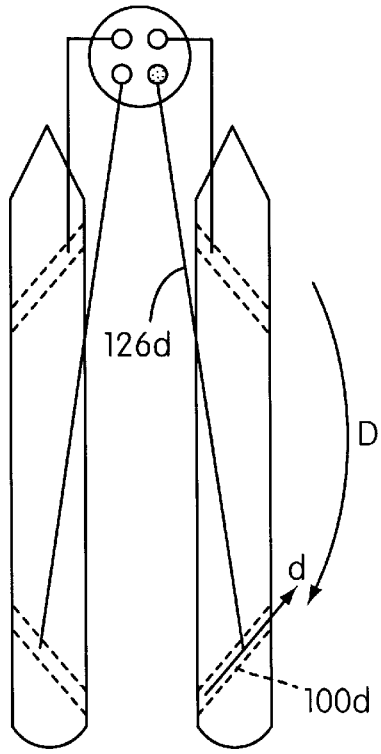
Figure 41:
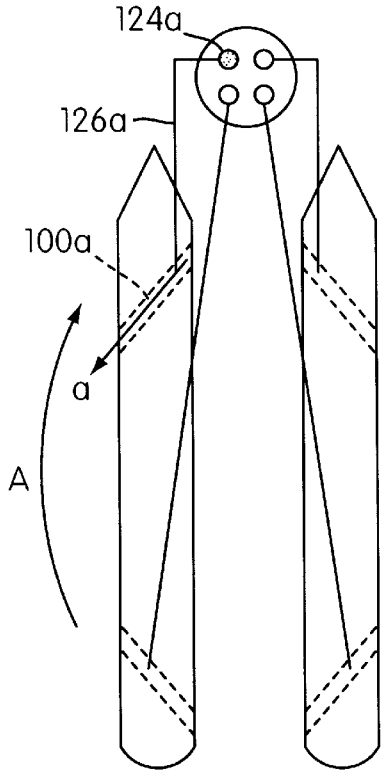
Figure 42:
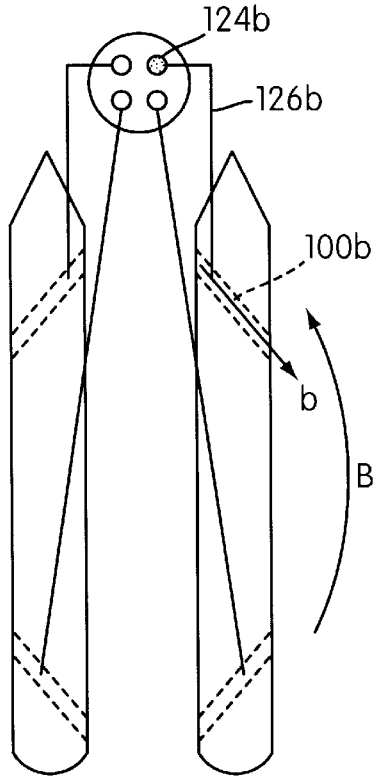

FIGS. 39–48 illustrate the outward thrust alternative. As seen in FIG. 39 actuation of rear port side troller mechanism 100*c* produces thrust c which moves the boat in a wide turn C toward the right and the rear. When starboard side rear troller mechanism 100*d* is actuated, a thrust d is created and the boat turns to the left and rear in a wide turn D as shown in FIG. 40. Actuation of the port side front troller mechanism 100*a* creates a thrust a resulting in a wide right turn A (as in FIG. 41). As seen in FIG. 42, actuation of troller mechanism 100*b* on the front, starboard side creates a thrust b which turns the boat into a wide turn B to the left.

Figure 43:
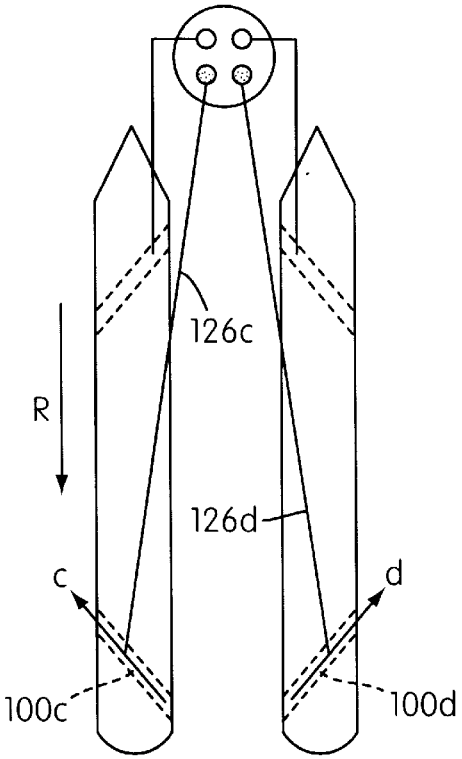
Figure 44:
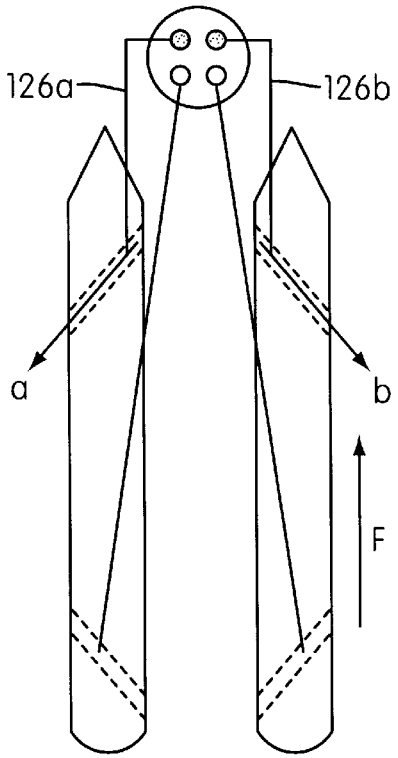
Figure 45:
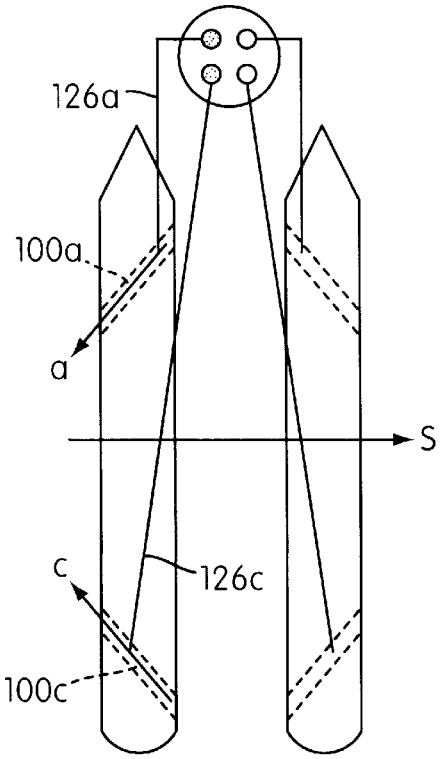
Figure 46:
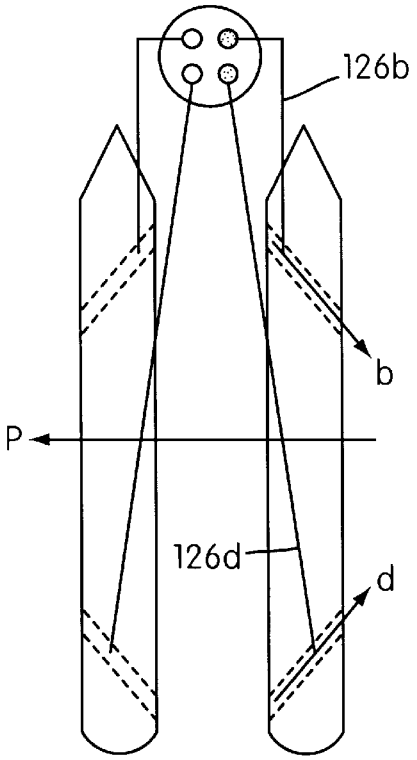

When both rear troller mechanisms 100*c* and 100*d* are actuated simultaneously, thrusts c and d combine in a resultant rearward movement R shown in FIG. 43. Similarly, when both front troller mechanisms 100*a* and 100*b* are actuated simultaneously, thrusts a and b combine in a resultant forward movement F of the boat as shown in FIG. 44. If the port side troller mechanisms 100*a* and 100*c* are actuated, thrusts a and c combine in a resultant movement S to the starboard side as seen in FIG. 45. Actuation of starboard side troller mechanisms 100*b* and 100*d* creates thrusts b and d which combine in a resultant movement of the boat P to the port side as seen in FIG. 46.

Figure 47:
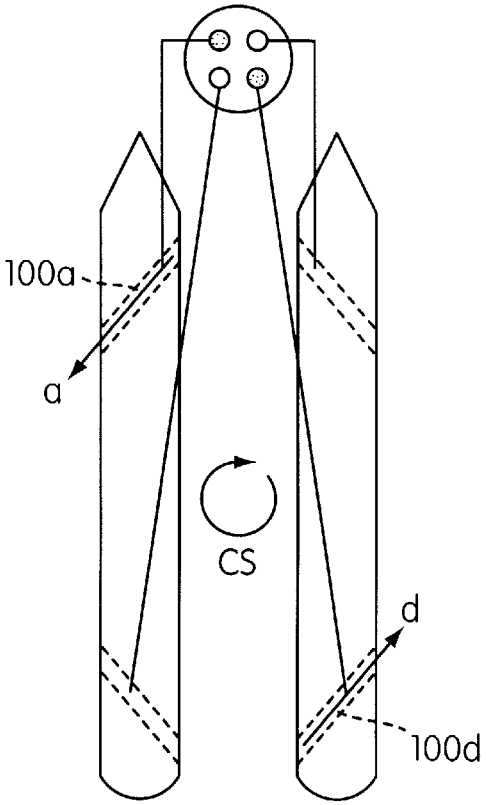
Figure 48:
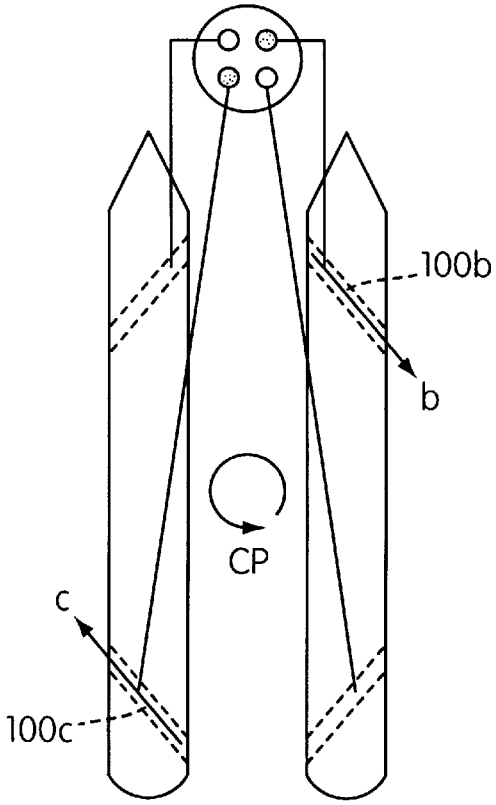

Actuation of front port side troller mechanism 100*a* and rear starboard side troller mechanism 100*d* produces thrusts a and d which cause the boat to move in a tight circle CS in a counter clockwise direction as shown in FIG. 47. If front starboard side troller mechanism 100*b* and rear port side troller mechanisms 100*c* are actuated, thrusts b and c are created which combine to move the boat in a tight circle CP in the counterclockwise direction as shown in FIG. 48.

The various embodiments of the trolling system of the present invention have been described at generally including one-way motors and impellers. Use of one directional motors typically simplifies the system, and in those instances when reversal is desired, i.e., such as to reverse the thrust to clear the debris screens, a simple reversal of current has been sufficient. Reversible motors, however, could certainly be used and are contemplated to be within the scope of the invention.

While the above description of the preferred embodiments of the invention have been described in the context of boats, the invention is not limited thereto. Various other boats, such as general leisure craft, amusement park rides, jon boats or ski boats can make use of the present invention.

Numerous characteristics, advantages and embodiments of the invention have been described in detail in the foregoing description with reference to the accompanying drawings. However, the disclosure is illustrative only and the invention is not limited to the precise embodiments illustrated. Various modifications and changes can be made herein by one of ordinary skill in the art without departing from the spirit or scope of the invention.

What is claimed is:

1. A fishing boat having a deck and defining a fore portion, a stern portion, a port side and a starboard side, said boat comprising:

a single piece hull with a plurality of cavities integrally formed therein below a water line, each said cavity having an intake end and an outtake end along a major axis, the major axis of each said cavity angled less than 90° relative to a longitudinal axis of said hull; and an electric, unidirectional thrust device disposed in each one of said cavities between the intake end and the outtake end so as to produce a thrust parallel to the major axis of said cavity, each said thrust device having an associated switch for actuating said thrust device, wherein said switches can be actuated alone or in combination to produce a resultant thrust to maneuver said boat.

2. The fishing boat of claim 1, wherein two of said cavities are fore portion cavities disposed in the fore portion of said hull, the major axes of said fore portion cavities being angled relative to the longitudinal axis of said hull so as to diverge toward the fore portion of said boat.

3. The fishing boat of claim 1, wherein two of said cavities, are fore portion cavities disposed in the fore portion of said hull, the major axes of said fore portion cavities being angle relative to the longitudinal axis of said hull so as to converge toward the fore portion of said boat.

4. The fishing boat of claim 1, wherein two of said cavities are stern portion cavities disposed in the stern portion of said hull, the major axes of said stern portion cavities being angled relative to the longitudinal axis of said hull so as to diverge toward the stern portion of said boat.

5. The fishing boat of claim 1, wherein two of said cavities are stern portion cavities disposed in the stem portion of said hull, the major axes of said stern portion cavities being angled relative to the longitudinal axis of said hull so as to converge toward the stern portion of said boat.

6. The fishing boat of claim 1, wherein said cavities comprise four cavities, two in the fore portion of the boat and two in the stern portion of the boat, the major axes of said cavities each angled less than 45° relative to the longitudinal axis of said hull.

7. The fishing boat of claim 1, further comprising a remote electronic controller disposed on the deck of said boat for individually actuating said thrust devices to move said boat in a desired direction by the resultant thrust.

8. The fishing boat of claim 1, wherein each said unidirectional thrust device comprises an impeller driven by an electric motor, and a flow straightener proximate the outtake end of said thrust device.

9. The fishing boat of claim 8, wherein each said flow straightener comprises a cylindrical thrust tube portion including flow straightening vanes and a compressor portion to increase thrust pressure.

10. The fishing boat of claim 8, wherein each said thrust device further comprises an exhaust port for pressure equalization.

11. A trolling water craft comprising:

a hull defining a deck portion, a fore portion, a stern portion, a port side and a starboard side, said hull comprising a pair of pontoons in generally parallel relation to one another and defining therebetween a longitudinal passageway; and a trolling system comprising a plurality of self-contained mechanisms disposed entirely within said hull of said water craft leaving said deck portion clear of any parts of said mechanisms, said mechanisms disposed in recesses angled between 20° and 40° relative to the longitudinal passageway defined by the pontoons, each of said self-contained mechanisms including a housing containing a motor near an intake end of said mechanism, and, in axial alignment, a rotatable unidirectional thrust producing device driven by said motor, and a flow straightener near an outtake end of said mechanism, such that all moving parts of said mechanism are confined to said hull, and electronic control means remotely disposed from said hull for individually actuating each of said mechanisms such that each of said mechanisms produces a thrust when actuated to move the water craft in a direction opposite to the direction of the thrust, wherein any one or a combination of said mechanisms may be actuated so that the water craft is moved in a desired direction by the resultant thrust.

12. The water craft of claim 11, wherein two of said recesses are fore portion recesses, a fore portion recess disposed in each of the pontoons, each of said fore portion recesses containing one of said mechanisms.

13. The water craft of claim 12, wherein said fore portion recesses are angled so as to diverge toward the stern portion of the water craft.

14. The water craft of claim 11, wherein two of said recesses are stern portion recesses, a stern portion recess disposed in each of the pontoons, each of said stern portion recesses containing one of said mechanisms.

15. The water craft of claim 14, wherein said stern portion recesses are angled so as to diverge toward the fore portion of the water craft.

16. The water craft of claim 11, wherein two of said recesses are fore portion recesses, a fore portion recess disposed in each of the pontoons, and two of said recesses are stern portion recesses, a stern portion recess disposed in each of the pontoons, each of said recesses containing one of said mechanisms.

17. The water craft of claim 16, wherein said fore portion recesses are angled so as to diverge toward the stem portion of the water craft, and said stern portion recesses are angled so as to diverge toward the fore portion of the water craft.

18. A trolling water craft comprising;

a deck and a pair of pontoons disposed underneath the deck and in parallel relation to one another defining a longitudinal passageway therebetween; and a trolling system comprising a pair of bores formed in each of said pontoons, said bores angled between 20° and 40° relative to the longitudinal passageway, a unidirectional fluid moving device disposed in each of said bores, each of said devices comprising a motor, an impeller and a flow straightener mounted in axial alignment, and a switch coupled to each of said fluid moving devices for actuating each device to produce a resultant thrust by movement of water through one or more of said angled bores to provide a trolling movement and accurate control of the pontoon boat.

19. An integral fishing boat hull comprising:

a plurality of integrally molded through-tubes provided in said hull below a water line, said tubes defining an intake end and an outtake end, each of said tubes being angled relative to a longitudinal axis of said hull;

a unidirectional fluid moving device disposed in each of said tubes, said device comprising an electric motor, an impeller and a flow straightener mounted in axial aligned within said tube; and a switch coupled to each of said fluid moving devices for actuating each device separately to produce a resultant thrust by movement of water through one or more of said tubes to move the boat in water.

20. The boat hull of claim 19 wherein said tubes are angled between 20° and 40° relative the longitudinal axis of said hull.

* * * * *

UNITED STATES PATENT AND TRADEMARK OFFICE

CERTIFICATE OF CORRECTION

PATENT NO. : 6,325,683 B1
DATED : December 4, 2001
INVENTOR(S) : Garey Yocom

It is certified that error appears in the above-identified patent and that said Letters Patent is hereby corrected as shown below:

Column 13,
Line 49, "stem" has been replaced with -- stern --.

Signed and Sealed this

Twenty-eighth Day of January, 2003

JAMES E. ROGAN
*Director of the United States Patent and Trademark Office*